US008429907B2

(12) United States Patent
Gronli

(10) Patent No.: US 8,429,907 B2
(45) Date of Patent: Apr. 30, 2013

(54) ACTIVE HYDRAULIC REGENERATION FOR MOTION CONTROL

(75) Inventor: Timothy D. Gronli, Machesney Park, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 970 days.

(21) Appl. No.: 12/496,115

(22) Filed: Jul. 1, 2009

(65) Prior Publication Data

US 2011/0000202 A1 Jan. 6, 2011

(51) Int. Cl.
*F04B 49/08* (2006.01)
*F15B 11/00* (2006.01)

(52) U.S. Cl.
USPC ..... 60/419; 60/414; 60/417

(58) Field of Classification Search ..... 60/414, 60/415, 417, 419, 486
See application file for complete search history.

(56) References Cited

U.S. PATENT DOCUMENTS 5,794,442 A * 8/1998 Lisniansky ..... 60/414
7,249,457 B2 * 7/2007 Raszga et al. ..... 60/414
7,712,309 B2 * 5/2010 Vigholm ..... 60/414
7,770,696 B2 * 8/2010 Futahashi et al. ..... 60/414

* cited by examiner

*Primary Examiner* — Thomas E Lazo
(74) *Attorney, Agent, or Firm* — Cantor Colburn LLP

(57) ABSTRACT

A hydraulic system including a hydraulic power source (102) having an output and a directional control valve (106) coupled to the output of the hydraulic power source. The system also includes a hydraulic cylinder (108) coupled to the directional control valve that receives hydraulic fluid at a first port and expels it at a second port as it moves a load (114) at a movement rate, a fixed displacement motor (150) coupled the directional control valve and receiving hydraulic fluid expelled by the hydraulic cylinder and a variable displacement pump (154) attached to a drive arm (152) of the motor.

18 Claims, 1 Drawing Sheet

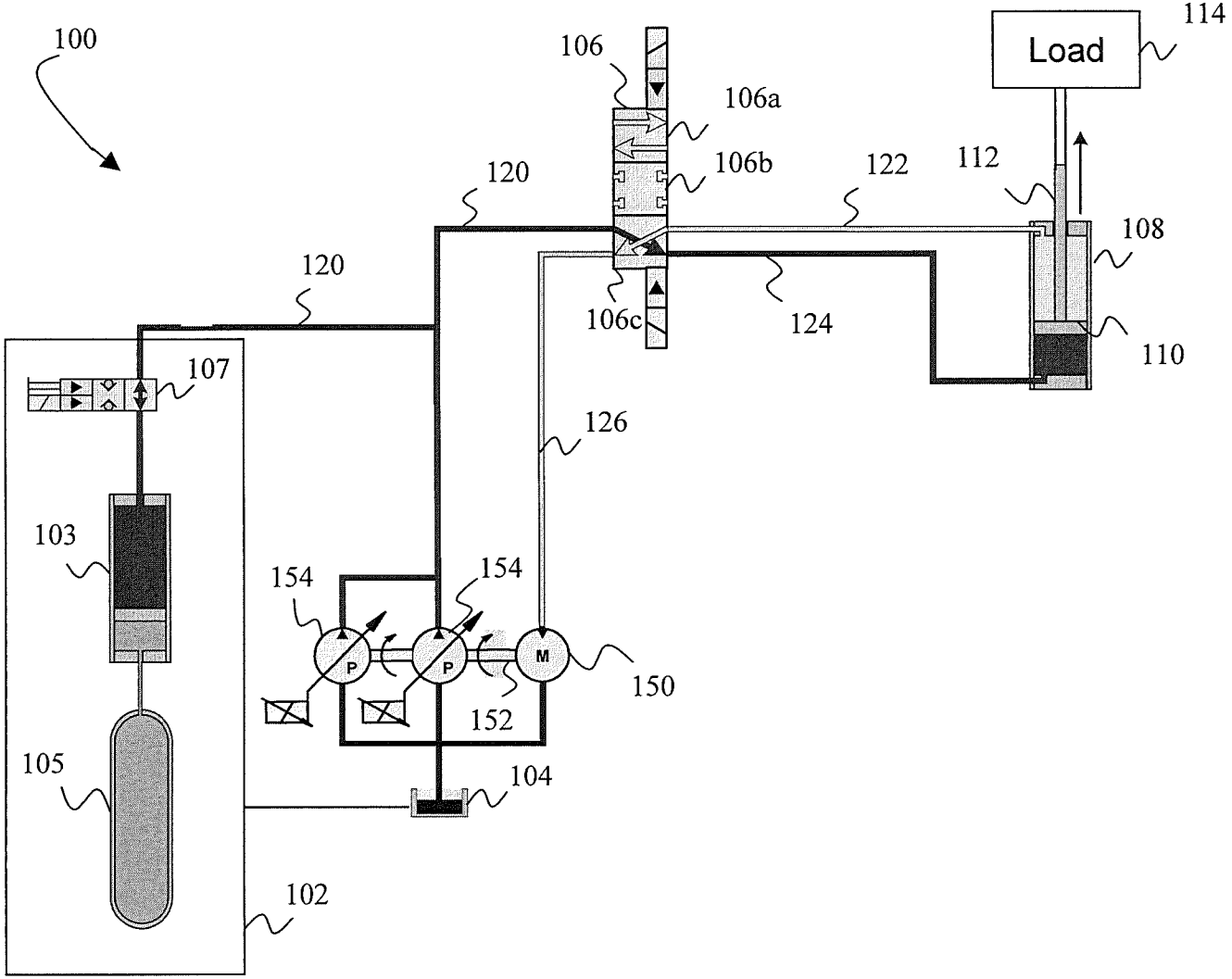
Load
114
108
110
112
122
124
106a
106b
106
106c
126
150
M
152
104
154
P
120
120
102
107
103
105
100

ACTIVE HYDRAULIC REGENERATION FOR MOTION CONTROL

BACKGROUND OF THE INVENTION

The subject matter disclosed herein relates to hydraulic motion control and, in particular to hydraulic fluid regeneration in a hydraulic motion control system.

Motion of a hydraulic cylinder is the result of the force balance between the load acting on the cylinder, the force of the pressure acting on one side of the cylinder piston and the force of the pressure acting on the other side of the cylinder piston. In typical systems one side of the cylinder is routed to a low-pressure reservoir, as a result the force seen by pressure on that side of the piston is typically negligible. The motion of the cylinder is then a function of the load and the pressure acting on the other side of the cylinder piston; this pressure shall be referred to as the control-pressure. The system controls the rate of cylinder actuation by changing control-pressure to shift the force balance causing the cylinder to decelerate, accelerate, or remain at a steady rate.

Controlling motion of a hydraulic cylinder acting on a load is typically achieved by throttling of the hydraulic fluid through a variable orifice such as a proportional direction control valve. The rate of a hydraulic cylinder output is controlled by changing the size of the control valve orifice to either increase or decrease the pressure drop of the high-pressure fluid coming from the power supply to some lower control-pressure through a throttling process. To increase the cylinder rate, or to react to an increasing load, the orifice would be increased in size, thereby reducing pressure drop through the valve and increasing control-pressure of the fluid flowing to the cylinder. Conversely, to decrease the cylinder velocity, or to react to a decreasing load, the orifice would be decreased in size, thereby increasing pressure drop through the valve and decreasing the control-pressure of the fluid flowing to the cylinder.

Typical hydraulic systems include a hydraulic power source providing flow of high-pressure hydraulic fluid. The high-pressure fluid passes though a control valve where the pressure is reduced to some lower control-pressure and then routed to a hydraulic machine such as a cylinder. The control valve may control which side of a piston head within the cylinder the control-pressure fluid is provided to and, thereby, control motion of the cylinder. The control valve may also route fluid exiting the cylinder to a low-pressure reservoir.

Multiplying the pressure drop through the control valve by the flow rate gives the power dissipated, or lost, by the control valve. The larger the pressure drop the larger the losses. For a system with varying loads on the cylinder this method is very inefficient. If the force on the cylinder becomes such that it aids its motion, the control valve must decrease its orifice size to prevent acceleration of the cylinder. Even with a reduced orifice, fluid from the hydraulic power source is still consumed and its energy dissipated by the control valve. The energy added to the system by the aiding force on the cylinder is also dissipated by the control valve. The dissipated energy causes an increase in the hydraulic fluid temperature.

Some actuation systems utilize a passive regeneration system which allows fluid exiting the rod end of the cylinder to flow back to the hydraulic power source supplementing flow from the hydraulic power source. In order for this type of regeneration to work, the pressure entering the cylinder and the pressure exiting the cylinder must be the same. Actuation force is developed due to the different surface areas on either side of the piston head due to the presence of the single-rod cylinder coupled to one side thereof. However, the actuation force created by such a system is not as large as is possible for a given cylinder not using passive regeneration. Passive regeneration can only be used on single-rod cylinders.

BRIEF DESCRIPTION OF THE INVENTION

According to one aspect of the invention, a hydraulic actuation system is disclosed. The system includes a hydraulic power source providing a hydraulic fluid and having an output and a directional control valve coupled to the output of the hydraulic power source and controlling a direction of hydraulic fluid flow in the system. The system also includes a hydraulic cylinder coupled to the directional control valve, the cylinder receiving hydraulic fluid at a first port and expelling hydraulic fluid at a second port and moving a load at a movement rate as a result of receiving hydraulic fluid. In addition, the system includes a fixed displacement motor coupled the directional control valve and receiving hydraulic fluid expelled by the hydraulic cylinder, the fixed displacement motor including a drive arm and a variable displacement pump attached to the drive arm and varying the movement rate by varying its displacement to either decrease or increase a torque applied to the drive arm.

Another embodiment of the present invention is directed to a method of operating a hydraulic system. The method includes causing the hydraulic piston to move in a first direction and controlling the movement rate by varying the displacement of the pump.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 1 is schematic of one embodiment of an active hydraulic system according to the present invention.

The detailed description explains embodiments of the invention, together with advantages and features, by way of example with reference to the drawings.

DETAILED DESCRIPTION OF THE INVENTION

Embodiments of the present invention are directed to active regeneration in a hydraulic system that may drive fixed or variable loads. Active regeneration is achieved by routing the flow of high-pressure hydraulic fluid from the hydraulic power source directly to the hydraulic cylinder without throttling it. That is, the control valve between the hydraulic power source and the cylinder is simply used for directional control. As such, unlike the prior art, the control valve does not cause power to be dissipated. The force balance is now a function of the load acting on the cylinder, the force of the high-pressure fluid acting on one side of the cylinder piston and the force of the control-pressure fluid acting on the other side of the cylinder piston.

In one embodiment, the flow of hydraulic fluid exiting the cylinder at control-pressure is routed through a fixed displacement motor where it is discharged to a low-pressure reservoir. The rate of fluid exiting the cylinder is a function of cylinder piston area and rate of piston travel. The flow through the motor causes it rotate at a speed directly proportional to the rate of fluid flow exiting the cylinder. The pressure of the control-pressure fluid is effected by the torque which is resisting the rotating motion of the motor. Increasing the resistive torque to the motor will cause the control-pressure to increase for a given cylinder load. Similarly, decreasing the torque to the motor will cause the control-pressure to decrease for a given cylinder load. Therefore, to increase the rate of cylinder actuation the resistive torque to the motor is decrease, causing the control-pressure to decrease. The decrease in control-pressure causes load balance of the cylinder to shift such that the cylinder accelerates. Similarly, to decrease the rate of cylinder actuation the resistive torque to the motor is increased, causing the control-pressure to increase. The increase in control-pressure causes load balance of the cylinder to shift such that the cylinder decelerates The resistive torque acting on the motor is provided by one or more variable displacement pump(s). The shafts of the motor and pump are coupled together. As flow exiting the cylinder causes the motor to rotate, the variable displacement pump also rotates. Rotation of the variable displacement pump causes it to draw fluid from the low-pressure reservoir. The fluid is discharged to the high-pressure side of the system. The pressure increase of the fluid caused by the pump results in a resistive torque being generated by the pump and applied to the motor. The amplitude of the torque is directly proportional to the displacement of the pump. For a given pressure differential, increasing the displacement will increase the torque and decreasing the displacement will decrease the torque.

In one embodiment, control of the cylinder actuation speed is achieved by varying the displacement of the pump. As the pump displacement increases, the torque on the motor increases. Increasing the torque on the motor increases the pressure exiting the cylinder. Thus, to change cylinder rate or to react to a changing load seen by the cylinder, cylinder rate can be controlled by varying the pump displacement.

The high-pressure hydraulic fluid flow output of the pump can be regenerated back into the system to supplement the flow of fluid out of the power source or stored for later use in an accumulator that forms part of the hydraulic power source. Storing or redirecting the fluid output, thus, allows the energy not required for cylinder actuation to be regenerated back into the system, instead of throttled and dissipated into the fluid. If the load on the cylinder becomes aiding, the active regeneration system can capture the energy acting on the cylinder by drawing fluid from the "unpowered" hydraulic fluid tank (referred to as a "reservoir" herein), allowing it to be stored for later use.

FIG. 1 shows an example of a system 100 according to an embodiment of the present invention. This system 100 includes a hydraulic power source 102. The hydraulic power source 102 may be any type of hydraulic power source and serves to provide flow of pressurized hydraulic liquid. The hydraulic power source 102 may include an accumulator 103 for receiving and storing output flow from the variable displacement pump(s). In one embodiment, the hydraulic power source may also include a pressurized gas tank 105.

The hydraulic power source 102 may be coupled to a low-pressure reservoir 104 that stores unpressurized hydraulic liquid. Of course, the system 100 may also include prior art components configured to pressurize hydraulic liquid stored in the accumulator 103. In addition, it should be noted that the hydraulic power source 102 may be any configuration and is not limited to that described here.

The hydraulic power source 102 may have an output coupled to a directional control valve 106. Coupling in the system 100 may be accomplished by pipes or other tubing. In addition, the hydraulic power source 102 may also include a power source shut-off valve 107. Of course, and as will become apparent below, the shut-valve may only be used to close the power source 102. Otherwise, the power source is fully open in most embodiments of the present invention.

In one embodiment, the directional control valve 106 may only control the direction of flow of the hydraulic liquid. That is, in one embodiment, the directional control valve 106 may not include any throttling ability. Accordingly, in such an embodiment, the rate of flow is not controlled by the directional control valve 106. In such an embodiment, the hydraulic power source 102 is always operated in the fully on or fully off positions. That is, if the hydraulic power source 102 is providing hydraulic power, it is providing 100% of the pressure. Otherwise, it is off. Advantageously, because the directional control valve 106 does not throttle the liquid it does not dissipate energy from the liquid as in the prior art. Of course, a directional control valve 106 with throttling ability may be used in embodiments of the present invention and such use does not depart from the present invention. The directional control valve 106 may include three different directional settings 106*a*, 106*b*, and 106*c* which are described in greater detail below.

The directional control valve 106 is coupled to a hydraulic cylinder 108. The cylinder 108 includes a piston head 110 that is coupled to a shaft 112. The shaft 112 is coupled to a load 114. In operation, if the force from the pressure above piston head 110 exceeds sum of the force from the load 114 and the force from the pressure below it, the piston head 110 will accelerate downwards. If the force from the pressure above piston head 110 is less than the sum of the force from the load 114 and the force from the pressure below it, the piston head 110 will accelerate upwards.

The direction of piston head 110 movement (and therefore, the direction of shaft 112 movement) may be controlled by the directional control valve 106. In particular, to cause the piston 110 to move downwards, the first directional setting 106*a* which couples control line 120 to control line 122 and control line 124 to control line 126 may be used. In this configuration, high-pressure hydraulic liquid is provided from the hydraulic power source 102 to the top of the piston head 110. Fluid on the bottom side of the piston head 110 is expelled from the cylinder 108 at control-pressure through control lines 124 and 126 as the piston head 110 moves downwards. The fluid exiting the cylinder 108 is routed to the motor 150 through lines 124 and 126 where any unused energy is extracted from the fluid by the motor 150 and then regenerated into the lines 120 by the variable displacement pump(s) 154. In the prior art, without regeneration, high-pressure hydraulic liquid is throttled in the control valve where any unneeded energy is dissipated and then the control-pressure fluid is routed to the desired side of the piston head 110. Fluid expelled from the cylinder at low-pressure would simply be returned to the reservoir 104.

As in the prior art, to hold the piston in a fixed position, the directional control valve 106 may utilize the second setting 106*b* that does not allow fluid in or out of the cylinder 108. To move the piston upwards, the third directional setting 106*c* may be employed which couples control line 120 to control line 124 and control line 122 to control line 126.

The system 100 may include a fixed displacement hydraulic motor 150. As shown, the system includes only a single fixed displacement hydraulic motor 150 but multiple motors could be employed as will be realized by one of skill in the art. The fixed displacement hydraulic motor 150 is coupled to control line 126 and, as such, receives hydraulic fluid expelled from the cylinder 108. This fluid causes the motor to turn and convert the hydraulic energy into rotational mechanical energy. The drive arm 152 of the fixed displacement motor 150 is coupled to one or more variable displacement hydraulic pumps 154. The fluid input of the variable displacement hydraulic pumps 154 and the fluid output of the fixed displacement hydraulic motor 150 are coupled to the reservoir 104.

In operation, the flow exiting the cylinder 108 is then routed through the fixed displacement motor 150 which drives the variable displacement pump 154. Control of the cylinder 110 actuation speed is achieved by varying the displacement of the pump 154. As the pump 154 displacement increases the torque on the motor 150 increases. Increasing the torque on the motor 150 increases the pressure exiting the cylinder 108. As the load 114 seen by the cylinder 108 increases or decreases, cylinder velocity can be maintained or changed by varying the pump displacement.

The flow output of the pump 154 can be regenerated back into the cylinder 108 to supplement pump flow or stored in an accumulator (hydraulic power source 102) for future use, allowing the energy not required for cylinder 108 actuation to be regenerated back into the system, instead of throttled and dissipated into the fluid.

If the load on the cylinder 108 becomes aiding, the active regeneration system can capture the energy acting on the cylinder 108 by drawing fluid from the reservoir 104 allowing it to be stored for later use.

Of course the system 100 may also include control electronics that monitor the movement rate and direction of the piston head 110 to determine whether to increase or decrease the displacement of the pump(s) 154. Such control electronics and associated programming are within the knowledge of one of skill in the art.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A hydraulic actuation system comprising:

a hydraulic power source (102) providing a hydraulic fluid and having an output;

a directional control valve (106) coupled to the output of the hydraulic power source and controlling a direction of hydraulic fluid flow in the system;

a hydraulic cylinder (108) coupled to the directional control valve, the cylinder receiving hydraulic fluid at a first port and expelling hydraulic fluid at a second port and moving a load (114) at a movement rate as a result of receiving hydraulic fluid;

a fixed displacement motor (150) coupled the directional control valve and receiving hydraulic fluid expelled by the hydraulic cylinder, the fixed displacement motor including a drive arm (152); and a variable displacement pump (154) attached to the drive arm (152) and varying the movement rate by varying its displacement to either decrease or increase a torque applied to the drive arm (152) and having an output connected to the directional control valve.

2. The system of claim 1, wherein an output of the pump is coupled to the output of the hydraulic power source.

3. The system of claim 1, further comprising:

a reservoir (104) for receiving hydraulic fluid expelled from the cylinder.

4. The system of claim 3, wherein the power source, a flow output of the motor and a flow input of the pump are coupled to the reservoir.

5. The system of claim 1, further comprising:

a load (114) coupled to a piston of the hydraulic cylinder.

6. The system of claim 5, wherein the load is a variable load.

7. The system of claim 1, wherein increasing the displacement causes the movement rate to decrease.

8. The system of claim 1, wherein decreasing the displacement causes the movement rate to increase.

9. The system claim 1, wherein increasing the displacement increases the torque on the drive arm and decreases the movement rate.

10. The system of claim 1, wherein decreasing the displacement decreases the torque on the drive arm and increases the movement rate.

11. The system of claim 1, wherein the direction control valve does not include a variable orifice.

12. The system of claim 1, wherein, in operation, the direction control valve has a constant orifice size.

13. The system of claim 1, further comprising:

one or more additional fixed displacement motors.

14. A method of operating a hydraulic system, the system including a hydraulic power source (102) having an output, a directional control valve (106) coupled to the output of the hydraulic power source, a hydraulic cylinder (108) coupled to the directional control valve that receives hydraulic fluid at a first port and expels as it at a second port as it moves a load at a movement rate, a fixed displacement motor (150) coupled the directional control valve and receiving hydraulic fluid expelled by the hydraulic cylinder and a variable displacement pump (154) attached to a drive arm (152) of the motor and having an output connected to the directional control valve, the method comprising:

causing the hydraulic piston to move in a first direction; and controlling the movement rate by varying the displacement of the pump.

15. The method of claim 14, wherein controlling includes reducing the displacement to increase the movement rate for a fixed cylinder load.

16. The method of claim 14, wherein controlling includes increasing the displacement to reduce the movement rate for a fixed cylinder load.

17. The method of claim 14, wherein increasing the displacement increases a torque on the drive arm and reduces the movement rate for a fixed cylinder load.

18. The method of claim 14, wherein decreasing the displacement decreases a torque on the drive arm and increases the movement rate for a fixed cylinder load.

* * * * *